US006092469A

United States Patent [19]

Monsell

[11] Patent Number: 6,092,469

[45] Date of Patent: Jul. 25, 2000

[54] RADIALLY SIDE MOUNTED RAILWAY CAR TRUCK

[76] Inventor: Dale Monsell, 120 S. 44th St., Omaha, Nebr. 68131

[21] Appl. No.: 09/078,261

[22] Filed: May 13, 1998

Related U.S. Application Data

[60] Provisional application No. 60/047,082, May 19, 1997.

[51] Int. Cl.[7] ..... B61D 1/00; B61F 1/00

[52] U.S. Cl. ..... 105/165; 105/218.1; 105/453

[58] Field of Search ..... 105/182.1, 199.1, 105/199.3, 218.1, 453, 165, 167, 200

[56] References Cited

U.S. PATENT DOCUMENTS

| | | | |
|---|---|---|---|
| 2,296,103 | 9/1942 | Holland . | |
| 2,360,061 | 10/1944 | Jones . | |
| 3,517,620 | 6/1970 | Weber . | |
| 5,632,208 | 5/1997 | Weber | 105/218.1 |

OTHER PUBLICATIONS

National Castings Incorporated, "Axle Motion II Truck," Advertisement, p. 1.

List, H. A., "Design Rationale for a New lightweight, Heavy Duty Freight Car Truck," ASME Journal Paper, The American Society of Mechanical Engineers (New York, NY), p. 2, (Nov. 17, 1985).

Standard Car Truck Company, "Illustration of Frameless Radial low tare weight truck," ASME Journal Papers, The American Society of Mechanical Engineers (New York, NY), p. 1, (Jul. 24, 1986).

Hawthorne, V. T. and Smith S. W., "A Light–weight, Improved Performance Truck For The Trinity HRIT Car," ASME RTD–Vol., The American Society of Mechanical Engineers (New York, NY), p. 2, (Jul. 24, 1993).

American Steel Foundries, "ASF–2001 Truck System," Advertisement, American Steel Foundries (Chicago, IL), p. 2.

*Primary Examiner*—S. Joseph Morano
*Assistant Examiner*—Robert J. McCarry, Jr.
*Attorney, Agent, or Firm*—Philip J. Lee

[57] ABSTRACT

An improved railroad car wheel truck assembly comprises four arcuate weight bearing surfaces, one above each axle bearing, providing a direct load path such that a light weight frame can be used, each weight bearing surface being received within a matching arcuate channel mounted on the underside of the rail car body, the channels having a greater arc length that the corresponding weight bearing surface such that the wheel truck is allowed to rotate relative to the rail car body, about a central pivot pin, the wheel truck assembly further comprising a two part spring assemblies for each wheel with long springs that are always under compression and shorter springs that are compressed only when the car is under a load, each wheel spring assembly having one long spring that urges a wedge between the wheel truck frame and wheel set axle holding saddle to urge the wheel set and axle into alignment.

20 Claims, 3 Drawing Sheets

RADIALLY SIDE MOUNTED RAILWAY CAR TRUCK

I. RADIALLY SIDE MOUNTED RAILWAY CAR TRUCK

II. CROSS REFERENCE TO RELATED PROVISIONAL APPLICATION

This application claims the benefit of U.S. Provisional application No. 60/047,082, filed May 19, 1997.

III. BACKGROUND OF THE INVENTION

A. Field of Invention

The present invention relates generally to railroad cars and, and more particularly to a new and improved railroad car truck holding the wheels and supporting the railroad car body relative to the wheels.

B. Description of Related Art

An important design goal for railway freight cars particularly, for bulk train service, is the reduction of the tare weight of the vehicle itself. Thus the car can carry an increased weight of lading on each load trip for a given reduction in tare weight where car operation is at the maximum allowable weight on rail as determined by the wheel bearing size.

Considerable progress has been made in the reduction of the weight of the body of rail cars, particularly in the case of the high utilization coal car, with the use of aluminum construction. Relatively less progress has been made, however, in the reduction of the weight of the conventional four-wheel rail car truck which comprises the structure by which the rail car body is supported relative to the wheels. Generally, each rail car is supported by two truck assemblies, with one at each end of the rail car, and each truck assembly comprises two wheelsets comprising a pair of wheels and the axle therebetween. Since the two truck assemblies must bear the entire weight of the rail car body and load, the truck assemblies are substantial and approximately one-half of the total rail car tare weight may be contributed by the truck system. A factor commonly contributing to the overall weight of conventional truck systems is the need to allow the truck to pivot relative to the rail car body in order to allow the wheels to follow curving tracks. The need to support the entire load at the two pivot points, dictates that the supporting frame and bolster members on the rail car truck and on the rail car body must be quite substantial, and therefore, quite heavy.

IV. SUMMARY OF THE INVENTION

This invention presents a design of a rail car truck for maximum reduction of the weight of that component. The present invention comprises a railroad car truck assembly having a radial side mounting support of the car body permitting the truck to swivel relative to the car body while transmitting axle loading in a direct load path to the car body. The truck assembly comprises a lightweight truck frame without a heavy central bolster member such as is commonly used to support a center pivot point in a conventional truck. The rail car body is supported above each of the four wheelset journal bearings by a flat, arcuate, horizontal and upward facing support member which is supported by the truck frame. The rail car body, at each end comprises four corresponding arcuate channel members sized and shaped to receive the truck mounted support members and having a flat, horizontal and downward facing surface in the same shape as, but longer than, the truck mounted support member surfaces.

A non-load bearing pivot sleeve is mounted in the center of the truck frame and is formed to receive a pivot pin extending downward from the underside of the car body. The distance from the central pivot point determines the radius of curvature of the edges of the support surfaces as well as the channel members such that the truck assembly is able to swivel about the pivot point while the support member surfaces are engaged within the channel members. A minimal radial clearance between each support member edge and channel member flange allows the engagement of the pivot pin within the pivot sleeve to restrain the horizontal displacement of the truck which has only a range of rotational movement relative to the car body. The arc contained by the channel members being longer than the arc of the support members, a limited range of rotational movement relative to the car body is permitted. The opposing support surfaces are formed of substances that provide durable wear and as little sliding friction as possible.

The improved rail car truck of the present invention includes improved spring assemblies. The wheel set axles are received in journal bearings that are in turn retained within saddle assemblies which are in turn received within the truck frame. The saddle assemblies provide lower spring support surfaces that secure the lower ends of two pairs of springs, the upper ends of which springs engage opposing surfaces on the truck frame. For each wheelset bearing, the springs of one of the two spring pairs are longer than the other springs such that when the car is empty, only the two longer springs engage and are compressed between the truck and saddle assembly. In this manner, the unloaded car is suspended by an appropriately softer suspension load, while the fully loaded car is suspended by both spring pairs for a stiffer suspension.

Each wheelset saddle is aligned within the frame by means of a truck stabilizing wedge block member which comprises a generally wedge shaped member with a vertical surface that engages an opposing surface on the saddle normal to the direction of travel and an inclined surface that engages an opposing inclined surface on the truck. The bottom of the wedge member engages one of the longer springs which urges the wedge member upward against the inclined surface and the interaction of the two opposing inclined surfaces causes the wedge member to slide forward against the vertical surface of the saddle. The resulting single side arrangement of the stabilizing wedge block members acting on wheelset saddles tends to hold the saddles and thus the wheelsets in a squared and parallel relationship within the truck frame assembly. An elastomeric wheel bearing adapter mounting is placed between the top of the wheelset bearing and the saddle to give the truck a radial turning capacity for curving as well as a form of primary suspension for added ride cushioning.

The different truck design features combine to form a unique primary suspension and support system functioning effectively to permit truck swiveling while providing an essentially direct load path from each of the wheelset axle journal bearings to the rail car body. The present invention permits minimum truck frame structure and weight and thus the weight of the entire truck assembly is minimized. Also accomplished by the resulting truck assembly are other design goals for improved freight car trucks in general, e.g., improved ride, increased wheelset hunting control, and reduced wheel wear.

The principal aim of the present invention is to provide a new and improved railroad car wheel truck which meets the foregoing requirements and which is lighter than conventional wheel trucks.

Another and further object and aim of the present invention is to provide a new and improved railroad car wheel truck which meets the foregoing requirements and which will be compatible with conventional rail car bodies.

Yet another and further object and aim of the present invention is to provide a new and improved railroad car wheel truck which meets the foregoing requirements and which also meets the necessary truck performance requirements when the car is empty.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the claims.

V. DESCRIPTION OF THE DRAWINGS

VI. DESCRIPTION OF THE PREFERRED EMBODIMENT(S)

Figure 1:
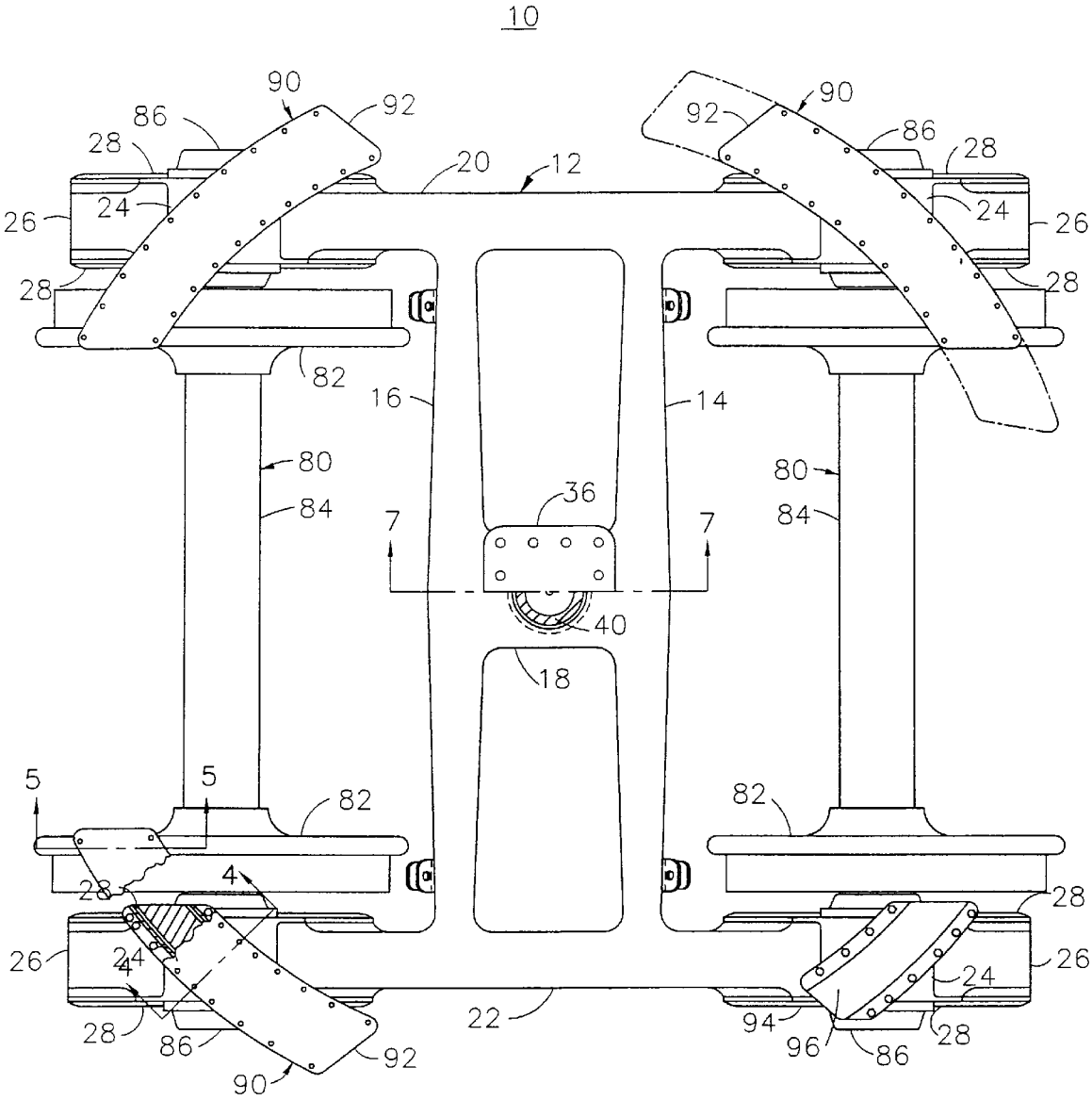
FIG. 1 is a plan view of the truck assembly in accord with the present invention with a partially cut-away sectional view of a radial mount, the mating truck mounted support member, and the centrally located pin and housing combination.
Figure 2:
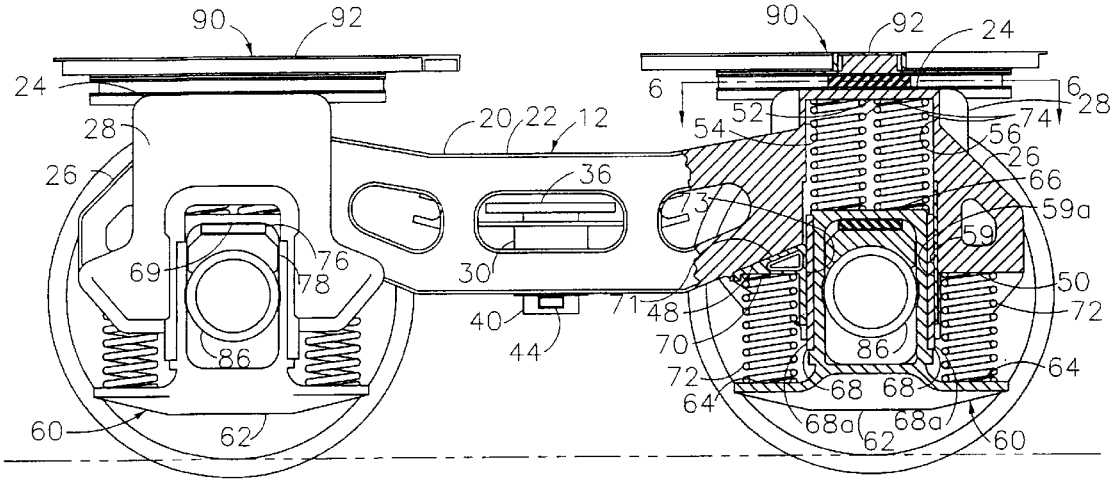
FIG. 2 is a side profile view of the truck assembly with a partial sectional side view including the radial mount assembly and the wheelset saddle springing in accord with the present invention.
Figure 3:
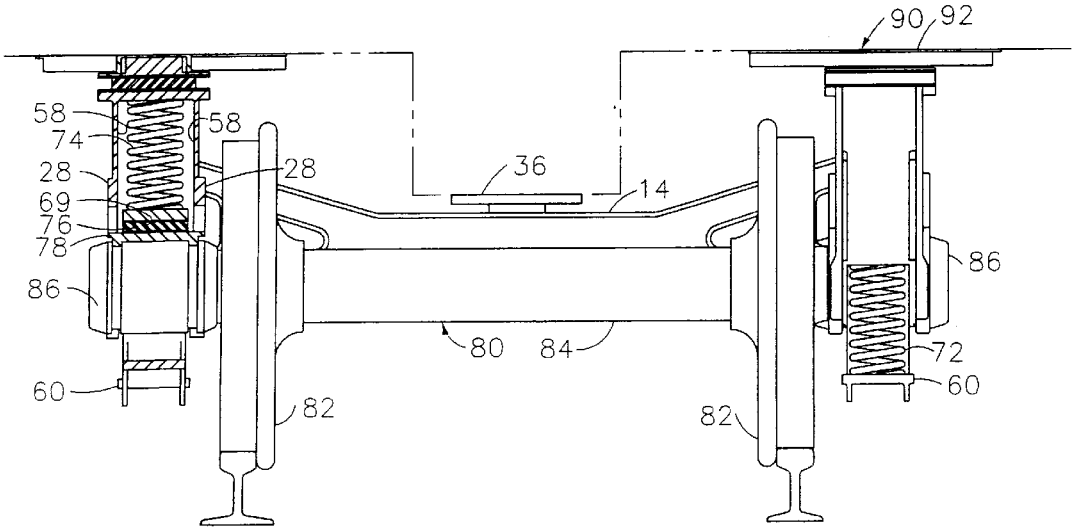
FIG. 3 is an end view of a truck assembly in accord with the present invention with a partial sectional view including the radial mount assembly and the wheelset saddle springing system.

Referring to the drawing figures, the railroad car truck assembly is generally designate in FIGS. 1, 2, and 3 by the numeral 10 and includes the truck assembly frame 12 shown by the FIGS. 1, 2, and 3. Frame 12 is a rigid type frame for essentially holding the wheelsets 80 of the truck assembly 10 in the required relative horizontal position and included no heavy cross-support bolster type member. For lighter weight frame 12 uses a general I-beam type cross sectional construction of side frame sections 20 and 22 and cross-connecting structural members 14 and 16. Incorporated in the frame assembly 12 are downwardly open recesses to receive the respective four wheelset holding saddle assemblies 60, each saddle assembly 60 having supporting truck springing systems and a stabilizing wedge block member 70. The respective four radial support assemblies 90 are mounted on raised pedestals 24 at the four corners of the truck frame assembly 12 to provide sufficient clearance of the car body over the wheels.

Figure 4:
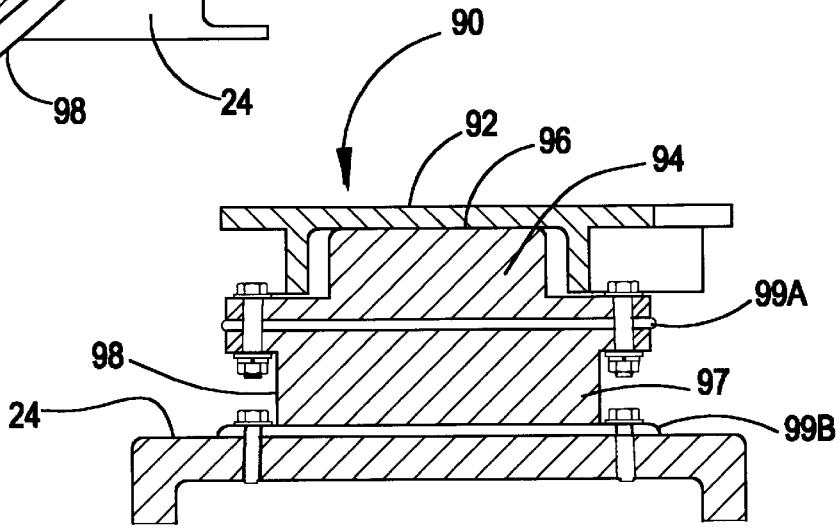
FIG. 4 is a cross section view taken through line 4—4 in FIG. 1, showing a part of the preferred embodiment including the radial mount assembly in accord with the present invention.

Again referring to the drawing figures, the arrangement of the radial side support assemblies 90 is shown by the FIGS. 1, 2, 3, and 4 with FIG. 4 best detailing the cross sectional construction of each support assembly 90. As seen, the mounting of the car body on the truck assembly 10 could be described as a 4-point mount with each support assembly 90 centered longitudinally and laterally over the respective wheelset axle bearing 86. Each support assembly 90 consists of a rectangular cross section support member 94 circular curved in the horizontal plane and contained and sliding within a corresponding downwardly facing channel member 92 mounted on the car body. The support member 94 is given low resistive sliding movement within the channel member as by low frictional sliding surfaces 96.

Within each support assembly 90 the support member 94 mounts on an elastomeric pad assembly 98 comprised of an elastomeric element 97 contained by the bearing plates 99A and 99B. In turn, the pad assembly 98 is mounted on the raised pedestal portion 24 of the truck frame 12. Purpose of elastomeric pad assembly 98 is to further insure free sliding movement of the support member 94 within the channel member 92 by accommodating any resulting inaccuracies in alignment between these members, in either vertical or horizontal planes.

Figure 6:
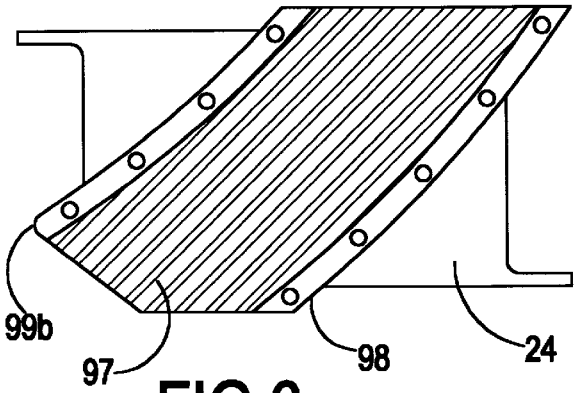
FIG. 6 is a partial top sectional view taken through line 6—6 in FIG. 2, showing the horizontal support surface of an elastomeric support, in accord with the present invention.

An important truck design feature is particularly indicated by the FIG. 6 for the horizontal support area of the elastomeric element 97 of each pad assembly 98. It should be noted that the load support area of element 97 is so proportioned over the longitudinal and lateral centerline axes of the respective wheelset axle bearing 86 to produce a balanced loading by the support assembly 90 on the truck frame 12 over the axle bearing 86.

A truck center section 18 is located in the center of the truck frame assembly 12 as indicated in the FIG. 1. Center section 18 incorporates a sleeve housing 30 which receives a large vertically oriented pin 40 being a portion of the car body mounted center pin and flange member 36 which is indicated in the FIGS. 1, 2, and 3. The center pin and flange member 36 along with the truck center section 18 and sleeve housing portion 30 are all further detailed in FIG. 7. The vertical center pin 40 and housing 30 combine to provide a specific center point for rotational movement of truck 10 relative to the car body (not shown), as well as horizontal restraint of truck 10, while taking no vertical loading.

Figure 7:
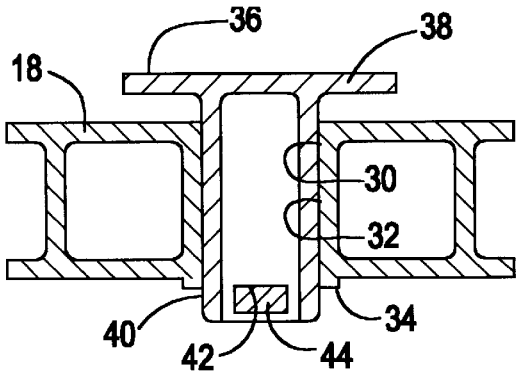
FIG. 7 is a partial sectional view taken through line 7—7 in FIG. 1, showing the centrally located pin and housing combination of a truck assembly in accord with the present invention.

As specially indicated in the cross section view of FIG. 7, the vertical pin 40 is made slidable vertically in the truck frame sleeve housing 30. However, because of the manner of support of the car body on the truck assembly 10, the truck frame 12 remains relatively fixed, fixed both vertically and horizontally with respect to the car body. A nominal spacing as shown by the FIG. 7 remains between the flange portion 38 of the center pin and flange member 36 and the truck frame center section 18. A cylindrical element 32 is placed between the pin member 40 and the frame 12 forming sleeve housing 30 and is bonded to the housing portion 30. Element 32 serves to assure free swiveling and low wear of the pin member 40 as provided by the low friction properties of the element 32. An interlocking bar member 44 is horizontally installed through openings 42 in the pin member 40 and extending below the lower opening 34 of housing 30 to optionally prevent any vertical lifting of the body mounted pin member 40 out of the sleeve housing portion 30 and in turn, any vertical separation between the car body and truck assembly 10 and those mount portions of support assemblies 90 as could possibly occur with car impacting. Cross connecting structural members 14 and 16 are strengthened in the fore and aft directions to withstand longitudinal impacting forces that could be imposed by the mass of the truck.

Wheelset holding saddle assemblies 60 of the truck assembly 10 are indicated in FIGS. 2 and 3 and are received within downwardly opening recesses in truck frame 12. As particularly shown in the right hand side cut away view of the FIG. 2, the saddle recess comprises downwardly facing support surfaces 48, 50, and 52, and the fore and aft inside walls 54 and 56, the latter being part of the longitudinally outward truck frame sections 26. Further forming the saddle recess, as shown by the FIG. 3 left hand side cut-away view, are inside lateral walls 58 being part of the side wall sections 28 of the truck frame assembly 12.

The wheelset holding saddle assemblies 60 provide a two-stage arrangement of the truck springing as best indicated by the right end sectional view of FIG. 2. The spring suspension system of truck 10 comprises a lower spring pair 72 and an upper spring pair 74 mounted on the respective support surfaces 64 and 66 of the saddle frame member 62. It should be noted that the lower spring pair 72 is of longer length than the upper spring pair 74, and that under light (empty) car loading condition the lower spring pair 72 is under deflection bearing the light car weight and the upper spring pair 74 is in near but not compressive contact with the truck frame surface 52. Lower springs 72 are of sufficiently greater free height to undergo initial truck loading and deflection up to the point of the light car weight before load contacting between the upper springs 74 and the truck frame 12. The upper springs 74 will then come into play to bear shared loading with the lower springs 72 upon greater car loading.

It should be noted at this point that the truck springing system of the present invention is as required for truck 10 to accommodate the rise and fall of the individual wheels 82 in following vertical track variations without undue loading or unloading of an individual wheel. It should be further noted that the two-stage arrangement of the primary suspension system of the present invention presents a lower vertical spring rate for the truck system in the light car condition than in the fully loaded car condition. As a result, in the light car condition, the individual wheels 82 can follow vertical track variations with less individual loading and unloading than would otherwise be the case with the full truck springing being in effect. In this manner, truck assembly 10 provides the necessary vertical wheel load equalizing ability for both the empty and fully loaded car conditions.

Also in light car conditions, the full car weight is born by the lower support springs 72, one of which of each pair supports a truck stabilizing wedge block member 70. Thus maximum possible loading is born by the wedge block members 70 in the light car condition, in turn producing maximum possible relative stiffness between the wheelsets 84 within the truck assembly 10 for maximum possible wheelset hunting control in the light car condition.

Each wedge block 70 comprises an inclined upper surface 71 and a vertical, saddle engaging surface 73 and saddle frame member 62 comprises vertical wear plates 68 presenting outwardly facing, wear surfaces 69A and 69B at forward and after ends. Wedge block inclined surface 71 is biased by one of the springs of lower spring pair 72 against a corresponding inclined surface 48 formed by frame 12 and the sliding engagement of the two inclined surfaces 71 and 48 urges the wedge block toward saddle frame member 62. As is best shown by the right hand side sectional view of FIG. 2 wedge block vertical surface 73 acts against the vertical wear surface 68*a* of the wear plate 68 which in turn forces the wear surface 68*a* of the corresponding opposite wear plate 68 against an opposed fixed vertical snubbing surface 59*a* of the wear plate 59 formed as a part of truck frame 12. Saddle frame member 62 is thus restrained against the vertical snubbing surface 59*a*. Assuming an accurate squared positioning of fixed surfaces 59*a* within the truck frame, the accurate relative squareness maintained between the saddle frame members 62 and in turn between the wheelsets 80 within the truck assembly 10 assures straight running of the truck 10 on straight track.

It has been noted that the lower springs 72 of the truck axle springing need be of greater free height than the upper springs 74. Also it should be assumed all springs bottom out simultaneously under truck spring solid loading conditions. However, it is intended that the added free height and longer length travel required of the lower springs 72 be obtained by a design involving the addition of extra coils, the lower and upper springs otherwise being the same regarding rod size, coil diameter, and pitch in the free state.

The general nature of the elastomeric mounting of the wheel bearing adapter 78 and thus that of the wheelset 80 within the saddle frame member 62 is indicated in the left hand view of the FIG. 2 and in the sectional views of both FIGS. 2 and 3. A downward facing mounting surface 69 of the saddle frame member 62 provides an upper restraint for an elastomeric pad 76 which is engaged on its lower surface by a bearing adapter 78. Each bearing adapter 78 holds a conventional roller journal bearing 86 mounted on an axle 84 of a conventional railway freight car wheel and axle set 80, each such wheelset comprised of the axle 84 and two flanged wheels 82. Each axle bearing 86 is mounted adjacent to a respective wheel 82. The manner of the elastomeric mounting of the wheelsets of truck 10 gives the truck 10 a self steering, radial turning capability on curved track.

It should be noted that with the given saddle member and suspension system, the upper spring pair 74 mounted on the saddle member support surface 66 provides direct support of the raised pedestal support 24 and thus a direct load path to the radial support assembly 90 above. In the case of the lower spring pair 72, the load path to the raised pedestal support 24 is closely adjacent that of the upper spring pair 74 thus resulting in a nearly direct load path through the truck frame structure to the radial mount assembly. As a result of the directness of the load path, L minimal structure of the truck frame 12 is required and thus minimum weight of the truck assembly 10 is achieved by the present invention.

Figure 5:
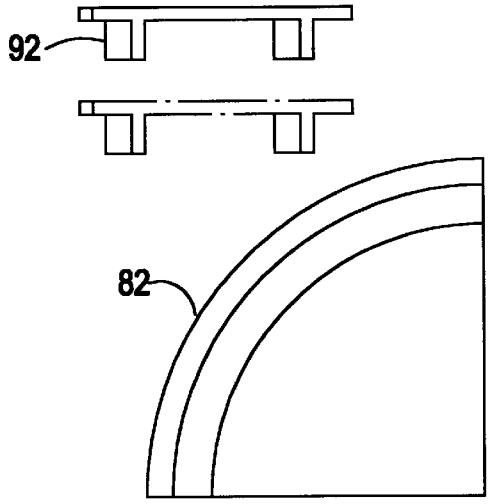
FIG. 5 is a partially sectional view taken through line 5—5 in FIG. 1, showing the car body mounted channel in two positions relative to the flange of the respective wheel, a first, unloaded car, position and a second position assumed when the springs are fully depressed.

FIG. 5 shows the designed relative total vertical spring travel for the truck 10 and the resulting minimum vertical clearance between the car body mounted channel member 92 of each support assembly 90 and the flange of the adjacent wheel 82. The vertical spring travel is shown for the truck load range from the light car condition to the spring solid condition and for the entire truck spring system, including the elastomeric wheel bearing adapter pad assembly 76, the truck coil springs 72 and 74, and the elastomeric pad 98 of the radial support assembly 90.

An alternative embodiment of the present invention is anticipated comprising an 8-point radial side mounting by the truck of the car body. Such alternative truck would utilize a single large pair of load carrying coil springs at each truck corner accompanied by a pair of smaller capacity, load carrying springs, one spring being a stabilizing wedge block support spring.

It is further anticipated that a low friction type wear material could be bonded to the load carrying support member 94 of the support assembly 90 to bear the vertical loading. Such material could also be bonded to the sides of support members 94 to prevent binding on incidental contact within channel 92. A tapered roller bearing installation could alternatively be used within the mount assembly replacing the flat support surfaces 96 while providing minimal rotational restraint of the truck 10.

Additionally, it is possible to provide shield plates covering the otherwise exposed underside support surfaces of each body mounted channel member 92. The shielding provided would be beneficial for protecting those support surfaces from the dirt and grit thrown up in ordinary train running and specially where having wheel flange and rail lubrication, for protecting those surfaces from contamination by the oil thrown up by the wheels. The shield plates would be formed by curved plate extensions on the truck mounted support member 94 of each support assembly 90.

Further anticipated is an adjusted arrangement requiring increased loading over the empty car condition before loading of the second stage springing comes into play. Such an adjustment would involve varied spring heights to insure unrestrained travel of the first stage springing in the light car condition.

It would also be advantageous to incorporate the suspension and wheel set saddle design features of the present invention in a conventional center plate center-point-of-support type truck. The result would be a form of rigid-frame, primary suspension truck in the weight range of the conventional 3-piece truck but of improved performance over the conventional truck as regarding wheelset hunting control, reduced wheel wear, and ride quality.

An alternative embodiment of the teachings of the present invention would be an embodiment (not shown in the Drawings) wherein the wheel truck frame bears the load of the car body when the car body is not loaded, ie. in the light car condition, in a more central bearing, while retaining the preferred radial load bearing system when under a load. In such an embodiment, a compressive member such as an elastomeric element could be installed vertically between the center of the truck frame and the center pin member flange of the car body. The added compressive member would be of sufficient preload capacity to suspend the empty car body and produce vertical separation between the radial car body/truck bearings. Upon loading the car body, the resultant compression of the compressive member would result in settling of the car body onto the radial bearings which would then bear the weight of the car lading. The foregoing alternative embodiment could achieve increased freedom of movement of the wheel truck relative to the car body, as may be required or desirous in some conditions.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. In particular, it will be anticipated that a variety of materials could be utilized, particularly in the friction bearing surfaces. Further, it is anticipated that variations in the configuration of the truck frame to car body mounting system could be employed without departing from the essential nature of the invention by moving the load radially outward from the central pivot while allowing rotation about the pivot point.

VII. CLAIMS

I claim:

1. A railroad car and wheel truck assembly having support means for rotatably supporting a railroad car body relative to at least one set of two wheels mounted on an axle and each axle is received within two axle bearings, each axle bearing being mounted adjacent to a wheel, the improvement comprising a plurality of car body weight bearing surfaces mounted on the wheel truck and opposing car body weight bearing surfaces mounted on the car body, each car body weight bearing surface being radially displaced from the central pivot point of the wheel truck relative to the car body and substantially over an axle bearing.

2. The railroad car and wheel truck assembly of claim 1, wherein at least one wheel truck mounted car body weight bearing surface and at least one opposing car body mounted car body weight bearing surface is mounted substantially over each axle bearing.

3. The railroad car and wheel truck assembly of claim 2, wherein the car body weight bearing support surfaces comprise horizontal arcuate surfaces, the curvature of which is that of an arc of radius equal to the distance between the support bearing and the central pivot.

4. The railroad car and wheel truck assembly of claim 3, wherein each car body mounted car body weight bearing surface is larger in horizontal dimensions than the opposing wheel truck mounted car body weight bearing surface and wherein a downward extending lip is secured to the perimeter of the car body mounted car body weight bearing surface such that the wheel truck mounted car body weight bearing surface fits within the car body mounted car body weight bearing surface lip.

5. The railroad car and wheel truck assembly of claim 4, wherein each car body weight bearing surface comprises an inner edge curved according to the radius equal to the distance between the car body weight bearing surface inner edge and the central pivot, and an outer edge curved according to the radius equal to the distance between the car body weight bearing surface outer edge and the central pivot, and the width of the support bearing assembly, consisting of the difference between the respective radii of the inner and outer edges, is uniform.

6. The railroad car and wheel truck assembly of claim 5, wherein the radius of the inner edge of the car body mounted car body weight bearing surface is slightly less than the radius of the inner edge of the wheel truck mounted car body weight bearing surface and the radius of the outer edge of the car body mounted car body weight bearing surface is slightly greater than the radius of the outer edge of the wheel truck mounted car body weight bearing surface.

7. The railroad car and wheel truck assembly of claim 6, wherein the arc length of the car body mounted car body weight bearing surface is greater than the are length of the wheel truck mounted car body weight bearing surface.

8. The railroad car and wheel truck assembly of claim 7, further comprising at least two wheel set suspension assemblies, each wheel set suspension assembly having at least one short spring and at least one longer spring, the longer springs being of sufficient length and having sufficient resilience to support the weight of the unloaded car body, such that the short springs is not compressed unless the car is loaded.

9. The railroad car and wheel truck assembly of claim 8, further comprising at least two wheel set suspension assemblies for each two wheel set, each wheel set suspension assemblies being loosely received within a recess in the wheel truck adjacent to a wheel.

10. The railroad car and wheel truck assembly of claim 9, wherein each wheel truck recess comprises an inclined inner wall and an opposing vertical inner wall and at least one longer spring of the suspension assembly urges a wedge between the inclined inner wall of the wheel truck recess and an outer surface of the wheel set axle bearing whereby the wheel set axle is urged into close alignment with the vertical inner wall of the wheel truck recess.

11. A railroad car and wheel truck assembly having means for rotatably engaging a railroad car body relative to a wheel truck comprising at least one set of two wheels mounted on an axle and each axle is received within two axle bearings, each axle bearing being mounted adjacent to a wheel, the improvement comprising a car body weight support bearing located between the car body and the wheel truck and substantially over each axle bearing.

12. The railroad car and wheel truck assembly of claim 11, wherein the car body weight support bearings comprise horizontal arcuate surfaces, the curvature of which is that of an arc of radius equal to the distance between the car body weight support bearing and the central pivot.

13. The railroad car and wheel truck assembly of claim 12, wherein each car body weight support bearing comprises a horizontal, upward facing, car body weight bearing surface secured to the wheel truck supported by the wheelsets and a corresponding horizontal, downward facing, car body weight bearing surface secured to the car body, the car body mounted car body weight bearing surface is larger in horizontal dimensions than the wheel truck mounted car body weight bearing surface and wherein a downward extending lip is secured to the perimeter of the car body mounted car body weight bearing surface such that the wheel truck mounted car body weight bearing surface fits within the car body mounted car body weight bearing surface lip.

14. The railroad car and wheel truck assembly of claim 13, wherein each car body weight bearing surface comprises an inner edge curved according to the radius equal to the distance between the car body weight bearing surface inner edge and the central pivot, and an outer edge curved according to the radius equal to the distance between the car body weight bearing surface outer edge and the central pivot, and the width of the car body weight support bearing assembly, consisting of the difference between the respective radii of the inner and outer edges, is uniform.

15. The railroad car and wheel truck assembly of claim 14, wherein the radius of the inner edge of the car body mounted car body weight bearing surface is slightly less than the radius of the inner edge of the wheel truck mounted car body weight bearing surface and the radius of the outer edge of the car body mounted car body weight bearing surface is slightly greater than the radius of the outer edge of the wheel truck mounted car body weight bearing surface.

16. The railroad car and wheel truck assembly of claim 15, wherein the arc length of the car body mounted car body weight bearing surface is greater than the arc length of the wheel truck mounted car body weight bearing surface.

17. The railroad car and wheel truck assembly of claim 16, further comprising a spring suspension assembly adjacent to each axle bearing comprising at least one short spring and at least one longer spring, the longer springs being of sufficient length and having sufficient resilience to support the weight of the unloaded car body, such that the short springs is not compressed unless the car is loaded.

18. The railroad car and wheel truck assembly of claim 17, wherein each wheel set suspension assembly is loosely received within a recess in the wheel truck, the recess comprising an inclined inner wall and an opposing vertical inner wall and at least one longer spring of the suspension assembly urges a wedge between the inclined inner wall of the wheel truck recess and an outer surface of the wheel set axle bearing whereby the wheel set axle is urged into close alignment with the vertical inner wall of the wheel truck recess.

19. A railroad car and wheel truck assembly having support means for rotatably supporting a railroad car body relative to at least one set of two wheels mounted on an axle and each axle is received within two axle bearings, each axle bearing being mounted adjacent to a wheel, the improvement comprising a compressible bearing proximate to the central pivot point of the wheel truck relative to the car body, and further comprising a plurality of car body weight bearing surfaces mounted on the wheel truck and opposing car body weight bearing surfaces mounted on the car body, each car body weight bearing surface being radially displaced from the central pivot point of the wheel truck relative to the car body.

20. The railroad car and wheel truck assembly of claim 19, wherein the radially displaced weight bearing surfaces do not bear the weight of the car body until the weight imposed on the central bearing exceeds a predetermined amount.

* * * * *